US006837031B1

(12) United States Patent
Hannen et al.

(10) Patent No.: US 6,837,031 B1
(45) Date of Patent: Jan. 4, 2005

(54) DEVICE FOR SHRINKING A SHRINK-WRAP FILM

(75) Inventors: Reiner Hannen, Kalkar (DE); Norbert Vermeulen, Kleve (DE)

(73) Assignee: MSK-Verpackungss-Systeme Gesellschaft Mit Beschrankter Haftung, Kleve (DE)

( * ) Notice: Subject to any disclaimer, the term of this patent is extended or adjusted under 35 U.S.C. 154(b) by 0 days.

(21) Appl. No.: 09/890,372

(22) PCT Filed: Jan. 21, 2000

(86) PCT No.: PCT/EP00/00444

§ 371 (c)(1),
(2), (4) Date: Sep. 13, 2001

(87) PCT Pub. No.: WO00/44626

PCT Pub. Date: Aug. 3, 2000

(30) Foreign Application Priority Data

Jan. 28, 1999 (DE) ..... 299 01 423
Apr. 1, 1999 (DE) ..... 299 05 931

(51) Int. Cl.[7] ..... B65B 53/02

(52) U.S. Cl. ..... 53/557; 53/427; 53/441; 53/442; 53/385.1

(58) Field of Search ..... 53/556, 557, 427, 53/441, 442, 218, 385.1

(56) References Cited

U.S. PATENT DOCUMENTS 3,662,512 A * 5/1972 Zeinick ..... 53/442
3,777,446 A * 12/1973 Graver ..... 53/442
3,807,126 A * 4/1974 Schwarz ..... 53/442
3,853,218 A * 12/1974 Grasvoll ..... 206/595
3,897,671 A * 8/1975 Higgins ..... 53/442
4,434,603 A * 3/1984 Beumer ..... 53/557
4,562,689 A * 1/1986 Hannen ..... 53/434
4,575,989 A * 3/1986 Hannen ..... 53/434
4,616,471 A * 10/1986 Hannen ..... 53/442
4,651,508 A * 3/1987 Hannen ..... 53/557
4,879,861 A * 11/1989 McAdams ..... 53/435
5,042,235 A 8/1991 Hannen et al.
5,247,783 A * 9/1993 Hannen ..... 53/567
5,502,947 A * 4/1996 Birkenfeld et al. ..... 53/442
6,453,643 B1 * 9/2002 Buscherini et al. ..... 53/399

FOREIGN PATENT DOCUMENTS

| | | |
|---|---|---|
| DE | 1 586 214 | 6/1972 |
| DE | 2 153 001 | 5/1973 |
| EP | 0 283 541 | 9/1988 |
| EP | 0 597 141 | 5/1994 |

* cited by examiner

*Primary Examiner*—Christopher R Harmon
(74) *Attorney, Agent, or Firm*—Herbert Dubno; Andrew Wilford

(57) ABSTRACT

The invention relates to an apparatus for shrinking a heat-shrink foil wrapped in particular about a palleted object stack. in order to improve on such an apparatus so that shrinking of the foil part projectingg past upper and/or lower face is pmproved and produces an optimal fold-free shrinkage, an apparatus for shrining a heat-shrink foil wrapped in particular about a palleted object stack comprises at least one shrink device movable vertically up and down on a frame to heat and shrink the heat-shrink foil, the heat-shrink foil projecting past the upper and/or lower edge of the object stack to form an upper and/or lower shrink formation, the apparatus further comprising at least one nozzle connected to a compressed air source and aimed centrally above and/or below the object stack and generally vertically directed thereat, each nozzle having outlet openings that extend at an angle not coinciding with the flow direction inside the nozzle and that are in an annular array.

7 Claims, 2 Drawing Sheets

DEVICE FOR SHRINKING A SHRINK-WRAP FILM

CROSS REFERENCE TO RELATED APPLICATIONS

This application is the US national phase of PCT application PCT/EP00/00444 filed 21 Jan. 2000 with a claim to the priority of German patent application 299 01 423.1 itself filed 28 Jan. 1999 and German patent application 299 05 931.6 itself filed 1 Apr. 1999.

FIELD OF THE INVENTION

The invention relates to an apparatus for shrinking a heat-shrink foil in particular wrapped around a palleted stack of objects.

BACKGROUND OF THE INVENTION

Such heat-shrink foils are used nowadays in order, for example, to secure objects for example to a pallet for transport. To this end a heat-shrink foil is wrapped around the stack of objects so that the heat-shrink foil does not slip down. This is done either directly in a shrink station or in a separate station upstream of the shrink station.

In the shrink station the heat-shrink foil is blasted by the shrink device with hot gas so that the heat-shrink foil is heated to its shrink temperature and is shrunk so as to pull together around the stack of objects. The shrink device is thus movable vertically up and down so that shrinking can take place from top to bottom or from bottom to top. During shrinking air is blow partially on the stack of objects from above.

U.S. Pat. No. 4,616,471 describes an apparatus for shrinking a heat-shrink foil forming a hood over a palleted object stack that is formed of at least one shrink device movable vertically up and down on a frame, the heat-shrink foil projecting past the lower face of the object stack.

A disadvantage is that this apparatus cannot produce a fold-free shrinking of the portion of the heat-shrink foil that projects above the top of the stack of objects so that for example a packing slip on the upper side of the stack of objects between the stack of objects and the heat-shrink foil, which carries a bar code, cannot be read.

OBJECT OF THE INVENTION

It is an object of the invention to improve on an apparatus of the described type so that shrinking of the portion of the foil projecting upward and/or downward is improved to produce an optimal fold-free shrink.

SUMMARY OF THE INVENTION

This object is attained by an apparatus for shrinking a heat-shrink foil wrapped in particular about a palleted object stack comprising at least one shrink device movable vertically up and down on a frame to heat and vertically shrink the heat-shrink foil, the heat-shrink foil projecting past the upper and/or lower edge of the object stack to form an upper and/or lower shrink formation, characterized in that the apparatus further comprises at least one nozzle connectable to a compressed-gas, especially a compressed-air source and aimed centrally above and/or below the object stack and generally vertically directed thereat, each nozzle having outlet openings that extend at an angle not coinciding with the flow direction inside the nozzle and that are in an annular array.

As a result of the angle of the outlet openings of the nozzles to the flow direction, the compressed air is not blown perpendicularly against the upper face of the object stack. Rather the compressed air is directed either obliquely against the upper surface and is there deflected against the projecting part of the foil, or—so long as the outlet openings open generally at a 90° angle to the flow direction inside the nozzle—is blown directly against the projecting foil part. As a result the projecting foil part is held up during the upper shrink phase so that it is uniformly heated by the shrink device during this upper shrink phase.

As a result of this uniform heating the projecting foil part shrinks without folds onto the upper side of the object stack.

Preferably each nozzle has a beveled end face in which the outlet openings are provided so that the compressed air is directed at this angle in all directions. The outlet openings extend generally at an angle of 45° to the flow direction in the nozzle.

In order that object stacks of different size can be provided with a shrunk foil in the shrink station, each nozzle is movable up and down. As a result the ideal spacing between the nozzle and the object stack can be set for the height of the object stack and/or the dimension of the upper face of the object stack.

BRIEF DESCRIPTION OF THE DRAWING

In the following an embodiment shown in the drawing is described. Therein.

SPECIFIC DESCRIPTION

Figure 1:
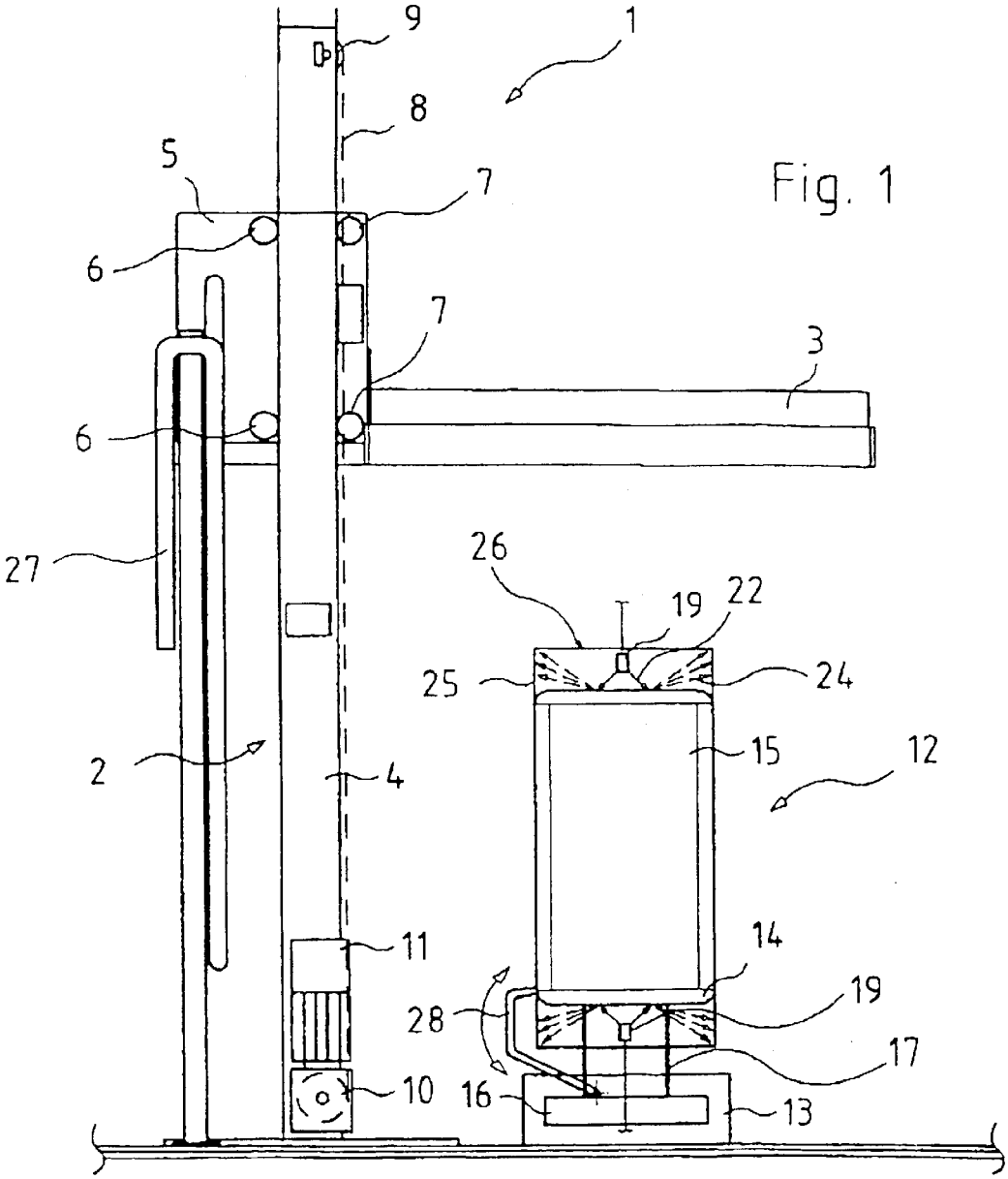
FIG. 1 is a side view of an apparatus according to the invention.

In the figures the same reference numerals are used for the same parts.

FIG. 1 shows a shrink station 1 that is formed of a frame 2 and a shrink device 3, e.g. constituted as a ring burner. The frame 2 has two masts 4 arranged next to another in a plane perpendicular to the view plane and of which only the front one is visible in this view. Both masts 4 are connected together at their upper ends by an unillustrated traverse. Each mast 4 carries a vertically movable carriage 5 guided by rollers 6 and 7. The carriages 5 are moved vertically by endless chains 8 looped at the upper and lower ends of the masts 4 over sprockets 9 and 10. A motor 11 provided in the lower region of the masts 4 drives the chains 8, both carriages 5 being moved synchronously so that they are always at the same height.

The carriages 5 are connected together by the shrink device 3 which has a shape corresponding to the footprint of a stack 12 of objects—in the illustrated example a polygonal frame-like shape—where the area inside the shrink device 3 is large enough that it can be moved vertically along the object stack 12.

Such an object stack 12 is underneath the shrink device 3 on a conveyor 13 that is formed for example as a chain, roller, or bar conveyor. The object stack 12 is comprised of a standard pallet 14 and a stack of objects 15 on it. If objects 15 of substantial size need to be packaged, no pallet 14 is needed.

Underneath the object stack 12 is a lift platform or device 16 on whose upper side a lift ram 17 can engage through an aperture in the conveyor 13 upward between the unillustrated support members of the pallet 14. A suction blower can be provided in the region of the ram 17 and underneath the conveyor 13.

Figure 2:
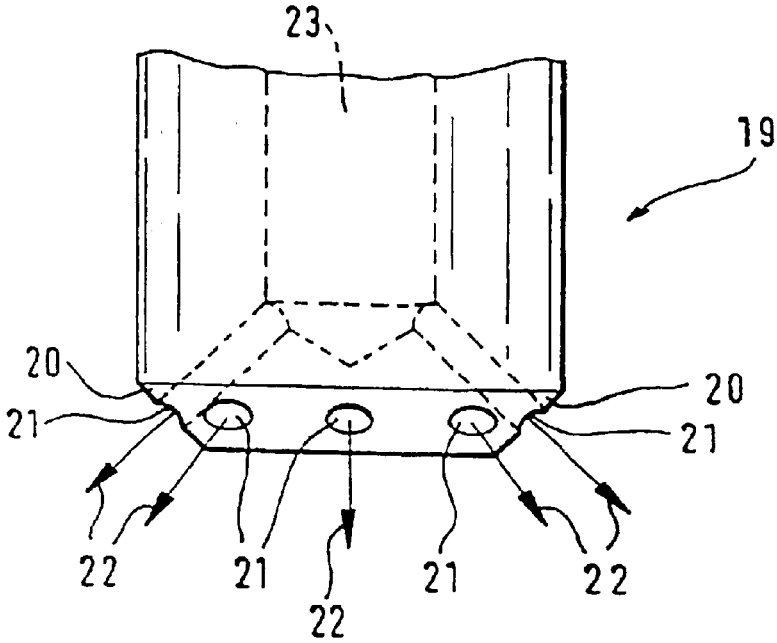
FIG. 2 is a view through the output part of a nozzle.
Figure 3:
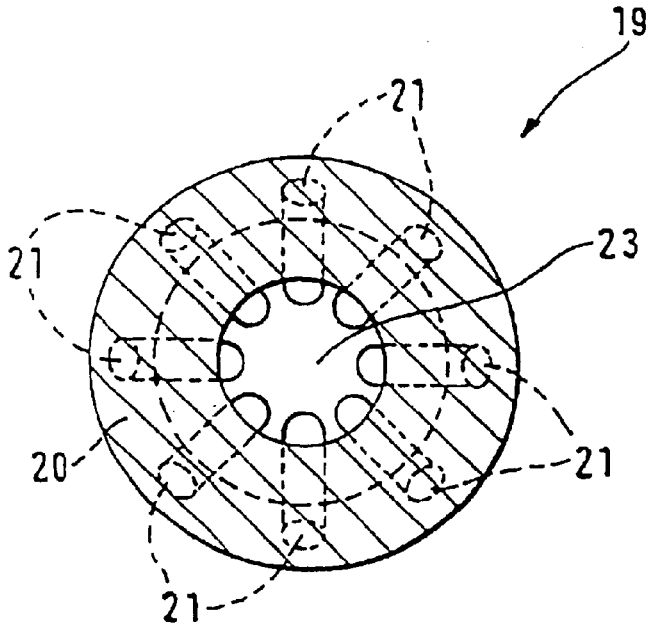
FIG. 3 is a section through the structure of FIG. 2.

Above the object stack 12 is a nozzle 19 that can also move up and down. The nozzle 19 is as shown in FIG. 2 of blunt shape and has an annular beveled edge face 20 that extends at an angle of about 45° to the flow direction inside the nozzle 19. Openings 21 in this edge face 20 direct jets of compressed air at an angle at the object stack 12 (arrow 22). As shown in FIG. 3 the outlet openings 21 extend like a star from a supply passage 23 provided centrally in the nozzle 19.

When the compressed air strikes the upper side of the object stack 12 it is deflected as shown by arrows 24 and stands up and holds erect a projecting portion 25 of a heat-shrink foil 26. In addition the compressed air coming from the nozzles 19 directs hot air from the shrink device 3 to the inside of the projecting portion 25. The shrink device 3 is supplied with gas via a supply line 27.

When the nozzles 19 are only as shown provided shrinking, the outlet openings 21 are provided in an annular array around the face 20 as shown in FIG. 3 so that the compressed air moves outward in all directions. If on the contrary several nozzles 19 are provided, the outlet openings 21 of each nozzle 19 are preferably set such that each nozzle 19 directs its compressed air only at a particular portion of the object stack 12; at the same time the arrangement of the outlet openings 21 among the provided nozzles 19 is selected such that the projecting foil portion 25 of the heat-shrink foil 26 is stood up at every location by the compressed air.

Shrinking with the apparatus according to the invention takes place as follows:

First the object stack 12 is wrapped or wound with the heat-shrink foil 26. This can be done for example at a station upstream from the shrink station 1 or in the shrink station itself. When the wrapping takes place in a separate station the object stack 12 surrounded by the heat-shrink foil 26 is transported by the conveyor 13 to the shrink station 1.

To both sides of the conveyor 13 are standard vertical foil rollers for applying the heat-shrink foil 26, from at least one of which the heat-shrink foil 26 rolls out. The two ends of the heat-shrink foils 26 pulled off the foil rolls are welded together. On passing the foil rolls, the object stack 12 is surrounded by the welded-together heat-shrink foils 26, the two heat-shrink foils 26 being joined together at the trailing region with a double weld seam.

Thereafter the heat-shrink foils 26 are cut apart between the two weld seams so that the next object stack 12 can be provided with a heat-shrink foil 26. The heat-shrink foil 26 engages the object stack 12 such that it does not slide down. It is possible to provided the object stack 12 in another manner with the heat-shrink foil 26.

In the shrink station 1 the heat-shrink foil 26 is shrunk by vertical movement of the shrink device 3. It is preferable that the shrinking takes place from top to bottom although shrinking in the opposite direction is possible.

In order to achieve a good shrinking in the upper region, that is in order to shrink the foil portion 25 projecting up above the object stack 12, compressed air is blown via the nozzles 19 against the upper surface of the object stack 12. The compressed air engages obliquely down on the object stack 12 (arrow 22) and is deflected thereby back up in the direction of the arrows 24. In this manner the projecting foil portion 25 is pushed outward and upward so that during the upper shrink phase it is erect and thus is uniformly heated by the hot gas from the shrink device 3.

As soon as the projecting foil portion 25 is heated to the shrink temperature, air feed to the nozzle 19 is cut so that the projecting foil 25 portion draws itself over the upper surface of the object stack 12.

Thereafter the shrink device 3 is moved downward to shrink the side surfaces of the object stack 12, so that the heat-shrink foil 26 pulls strongly together over the side surfaces of the object stack 12.

If shrinking underneath is desired, that is to engage the lower edge of the heat-shrink foil 26 around the object stack 12 or the pallet 15, the object stack 12 is raised somewhat by the ram 17 of the lifting device 16.

Then the shrink device is dropped down to the level of the conveyor 13 by movement of the carriages 5.

Now the lower edge of the heat-shrink foil 26 is acted on by the hot gas of the shrink device 3 so that it is heated to the shrink temperature and thus pulls tight around the lower face of the pallet 14. This drawing together can be assisted by an unillustrated suction fan.

Thereafter the object stack 12 with a still hot edge of the heat-shrink foil 26 is again set back down on the conveyor 13 so that the hot edge is pressed between the conveyor 13 and the lower surface of the pallet 15 so as to weld together the various layers of this edge. Thus the lower edge of the heat-shrink foil 26 gains an extremely good hold.

After the shrink process is over, the object stack 12 is moved out of the shrink station 1 by the conveyor 13. The above-described process is repeated for a new object stack.

What is claimed is:

1. An apparatus for shrinking a foil wrapped about a stack of objects and having an end portion projecting vertically past an end of the stack, the apparatus comprising:

a frame extending vertically adjacent the stack;

means including a heater vertically displaceable on the frame and directed inwardly at the wrapped stack for shrinking the foil thereabout;

a nozzle spaced vertically from the stack end, centered vertically on the stack, and having an annular array of outlets inside the projecting end portion of the foil and directed generally vertically and outwardly at an acute angle to the end of the stack; and means for supplying a gas under pressure to the nozzle for directing respective jets of the gas from the outlets at the projecting end portion of the foil for inflating and erecting the projecting end portion of the foil.

2. The foil-shrinking apparatus defined in claim 1 wherein the nozzle has an annular face extending at an acute angle to the end and formed with the outlets.

3. The foil-shrinking apparatus defined in claim 2 wherein the face and outlets extend at an angle of about 45° to a vertical centerline of the stack.

4. The foil-shrinking apparatus defined in claim 1, further comprising means for vertically moving the nozzle toward and away from the stack.

5. The foil-shrinking apparatus defined in claim 1 wherein the end is the upper end and the stack has a lower end past which the foil also extends, the apparatus further comprising:

a second such nozzle connected to the gas-supply means and directed at the lower end for inflating and erecting the projecting end portion of the foil.

6. The foil-shrinking apparatus defined in claim 1, further comprising:

means for pressing the foil against the stack as the foil is shrunk around the stack.

7. The foil-shrinking apparatus defined in claim 6, further comprising means including a lift table for raising the pressing means.

* * * * *